US006276562B1

(12) United States Patent
Hodge et al.

(10) Patent No.: US 6,276,562 B1
(45) Date of Patent: Aug. 21, 2001

(54) LID ROD SUPPORT ASSEMBLY FOR TRASH BIN

(75) Inventors: Allan M. Hodge; Anthony A. Hodge, both of San Diego, CA (US)

(73) Assignee: Hodge Products, Inc., El Cajon, CA (US)

( * ) Notice: Subject to any disclaimer, the term of this patent is extended or adjusted under 35 U.S.C. 154(b) by 0 days.

(21) Appl. No.: 09/449,872

(22) Filed: Nov. 29, 1999

(51) Int. Cl.[7] ..... B65D 43/24

(52) U.S. Cl. ..... 220/831; 220/744; 220/379; 16/374; 16/343; 248/213.1; 248/214

(58) Field of Search ..... 220/831, 832, 220/843, 844, 848, 744, 379, 908, FOR 193, FOR 201; 16/343, 346, 374, 377, 386; 248/202.1, 213.1, 213.2, 214, 907

(56) References Cited

U.S. PATENT DOCUMENTS

| | | | | |
|---|---|---|---|---|
| Re. 29,494 | | 12/1977 | Hodge . | |
| Re. 30,890 | | 3/1982 | Hodge . | |
| 259,318 | | 6/1882 | Kirk . | |
| 369,113 | | 8/1887 | King, Jr. . | |
| 498,020 | | 5/1893 | Murray . | |
| 498,569 | | 5/1893 | Peterson . | |
| 1,019,347 | | 3/1912 | Nickerson . | |
| 1,395,554 | | 11/1921 | Brown . | |
| 1,476,966 | | 12/1923 | Hachmann . | |
| 1,686,969 | | 10/1928 | Hebden . | |
| 1,850,894 | | 3/1932 | Punte et al. . | |
| 1,867,798 | | 7/1932 | Arndt . | |
| 2,541,604 | | 2/1951 | Normandin . | |
| 2,542,987 | * | 2/1951 | Brock | 220/844 X |
| 2,568,365 | | 9/1951 | Root . | |
| 2,622,761 | | 12/1952 | Linde . | |
| 2,730,253 | | 1/1956 | Oswalt . | |
| 3,126,120 | * | 3/1964 | Crate | 220/844 X |
| 3,136,575 | * | 6/1964 | Kolling | 220/844 X |
| 3,137,408 | | 6/1964 | Taylor . | |
| 3,687,317 | | 8/1972 | Gagel . | |
| 3,951,302 | | 4/1976 | Owen . | |
| 3,989,162 | | 11/1976 | Hodge et al. . | |
| 4,014,457 | | 3/1977 | Hodge . | |
| 4,098,429 | | 7/1978 | Hodge . | |
| 4,148,411 | | 4/1979 | Hodge et al. . | |
| 4,158,424 | * | 6/1979 | Carmack | 220/844 X |
| 4,182,530 | | 1/1980 | Hodge . | |
| 4,186,844 | | 2/1980 | Swanson . | |
| 4,375,711 | | 3/1983 | Franzen et al. . | |
| 4,773,555 | | 9/1988 | Merino . | |
| 5,085,341 | | 2/1992 | Hodge . | |
| 5,088,616 | * | 2/1992 | Susko et al. | 220/844 |
| 5,595,317 | | 1/1997 | Hodge . | |
| 5,653,001 | | 8/1997 | Lane . | |
| 5,975,345 | * | 11/1999 | Taylor | 220/831 X |
| 6,003,716 | * | 12/1999 | Allison et al. | 220/831 X |

FOREIGN PATENT DOCUMENTS

| | | |
|---|---|---|
| 503059 | 7/1930 | (DE) . |
| 506187 | 5/1939 | (GB) . |

* cited by examiner

*Primary Examiner*—Nathan J. Newhouse
(74) *Attorney, Agent, or Firm*—Brown, Martin, Haller & McClain, LLP

(57) ABSTRACT

A lid support assembly for a trash bin lid rod has a plurality of rod supports engaging the lid rod and secured to the rear wall of the bin to resist bending of the lid rod. An elongate lid prop has an opening for engaging over the lid rod with a first portion of the lid prop extending away from the opening in a first direction to provide a support for the trash bin lid in a partially open position, and a second portion extending in a second direction away from the first direction to engage the rear wall of the trash bin. Rod supports are positioned on opposite sides of the lid prop to secure the lid prop in the desired position on the lid rod.

20 Claims, 3 Drawing Sheets

LID ROD SUPPORT ASSEMBLY FOR TRASH BIN

BACKGROUND OF THE INVENTION

The present invention relates generally to commercial trash bins and is specifically concerned with a support assembly for the lid rod axle of such trash bins.

Large industrial trash bins of the type used in hotels, apartment complexes, commercial establishments, and the like, typically have one or more hinged lids that can be opened to deposit trash into the bin. The bins are designed to be lifted and emptied by a trash truck. A hydraulically operated lift on the truck engages the trash bin using two forks, lifts it above the truck, and inverts the bin. The lids swing open, and the contents of the bin fall into the truck.

The lids of conventional trash bins are typically hinged to the rear wall of the bin by means of lugs or flanges on the lid which engage over a hinge pin secured across the rear edge of the open top of the bin. When the lids are closed, they are oriented generally horizontally and perpendicular to the side walls of the bin. The lids can be swung open through an angle of approximately 270° to an orientation in which they lie alongside the rear wall of the bin. One problem with hinged lids of conventional trash bins is that the hinge pin or rod may tend to bend with time, potentially causing the lid to jam or become stuck in one position.

Another problem with commercial trash bins is that users often have difficulty managing the relatively heavy lids when depositing trash in the bin. The user can either swing the lid into the fully open position lying along the rear wall of the bin, in which case they have to walk around to the back of the bin in order to close the lid after depositing the trash, or can try to hold the lid open with one hand while depositing trash with the other hand. Both alternatives are cumbersome and inconvenient. Various types of lid props are available to try to avoid these problems, but all are subject to some disadvantages. Some lid props involve metal bars hinged inside the container. These tend to get dirty over time, and may become jammed. It is also known to weld a bar to the back of the trash bin in order to prop the lid open. The disadvantage of this is that the lid can never be completely opened, i.e. so that it rests against the back wall of the container.

In our U.S. Pat. No. 5,595,317, a lid prop is described which is designed to prop the lid of a trash bin in a partially open position. The prop is movable between a first position in which it props the lid in a partially open position, and a second position in which the lid can be swung fully open. The prop comprises a generally planar member having an elongated slot which engages over the hinge rod of a trash bin lid. The member has a lid supporting portion which projects upwardly from the slot to support the lid in a partially open position. The prop can be moved upwardly to clear the upper end of the bin, at which point the prop can be rotated about the hinge rod along with the lid to allow the lid to be swung fully open.

SUMMARY OF THE INVENTION

It is one object of the present invention to provide a new and improved support assembly for a trash bin lid rod. It is another object of the invention to provide a new and improved lid prop for propping a trash bin lid in a partially open position.

According to one aspect of the present invention, a trash bin with a rod support assembly is provided, which comprises a bin having an open top, at least one lid for closing the open top of the bin, the lid having a front edge, opposite side edges, and a rear edge, the bin having a rear wall with an upper rear edge, a hinge assembly pivotally connecting the rear edge of the lid to the rear edge of the bin for allowing the lid to pivot between a closed position covering the open top of the bin and an open position spaced from the open top of the bin, the hinge assembly comprising a pair of spaced hinges secured to the rear wall of the bin adjacent and spaced outwardly from the respective opposite side edges of the lid, and a hinge rod extending between the hinges and pivotally connected to the rear edge of the bin, and at least two rod supports secured at spaced intervals to the rear wall of the bin between the hinges and behind the rear edge of the lid, each rod support comprising a rigid member secured to the rear wall at a predetermined angle and having an opening engaging over the hinge rod for supporting the hinge rod and resisting bending of the rod, whereby the rod supports do not restrict movement of the lid between the closed and open position.

In current trash bin lid hinge assemblies, the lid hinges must be placed to one side of the respective lid side edges, and not behind the lid itself, since they will otherwise interfere with proper opening of the lid. The rod supports of this invention can be placed directly behind the lid without interfering with full opening of the lid, since they have upper end openings which engage over the lid rod to which the rear edge of the lid is hinged. Thus, the rear edge rotates around the lid rod and does not contact any of the rod supports. At the same time, the rod supports provide additional support to the rod and resist bending of the rod even in windy conditions.

In a preferred embodiment of the invention, each hinge rod support is secured to the upper edge of the rear wall of the bin and extends at an angle of around 45° rearwardly from the rear wall, and has an eyelet at its upper end engaging over the hinge pin. The hinge rod supports are preferably formed from flat metal strips welded at one end to the rear wall of the bin.

According to another aspect of the present invention, a lid prop apparatus is provided which comprises an elongate lid prop having an opening for engaging over a hinge rod of a trash bin, a first portion of the elongate member extending away from the opening in a first direction to provide a support for a trash bin lid in a partially open position, and a second portion of the elongate member extending in a second direction away from the first direction to engage the rear wall of the trash bin, and a pair of rod supports for engaging over the hinge rod on opposite sides of the elongate member to prevent sliding of the elongate member along the hinge rod and to provide additional support to the hinge rod, each rod support having a first end with an opening for securing over the hinge rod on a respective side of the lid prop, and a second end for securing to the rear wall of a trash bin.

Preferably, the lid prop comprises an elongate rod or bar which is bent to form the opening or which has an eyelet secured at an intermediate position in its length to form the opening. The lid prop may be formed rigidly in one piece from a single rod or bar, or may be formed in two parts, a first part having the opening or eyelet and the second part being slidably mounted on the first part. By providing hinge rod supports on opposite sides of the lid prop, the lid prop itself does not have to be extended laterally along part of the length of the hinge rod, as in prior art arrangements, and is cheaper to manufacture. The rod or end supports ensure that the lid prop remains in the optimum position for supporting the lid. Without the supports, the lid prop may travel along the hinge rod to a position which is not optimum and which could allow the lid rod to bend and become inoperable.

The lid prop may be stationary so that the lid is always held in a partially open position when opened, or may be movable between a first position in which it props the lid partially open and a second position in which it allows the lid to swing fully open. In one embodiment, a stationary lid prop comprises a single elongate rod having an eyelet at an intermediate position in its length for engaging the hinge rod, so that one end of the rod on one side of the eyelet engages the rear wall of the container and the other part of the rod on the opposite side of the eyelet engages and supports the lid when it is opened.

In another embodiment of the invention, the lid prop comprises a single elongate bar or rod bent back at one end and re-attached at an intermediate point in its length to form an elongate slot for engaging over the hinge rod. With the lid prop in one orientation, an upper end of the slot engages over the hinge rod at the intermediate point of the length of the rod, and the non-bent end of the rod projects upwardly to form the prop for the lid. The lid prop can be raised from this position with the hinge rod sliding along the slot to its lower end, at which point the prop is free to rotate around the hinge rod with the lid, allowing the lid to swing fully open.

In a third embodiment of the invention, the lid prop is formed in two parts. The first part has an opening or eyelet at one end for engaging over the hinge rod. The second part comprises an elongate rod slidably connected to the first part to extend alongside and parallel to the first part between a retracted position in which it does not project below the eyelet, and an extended position in which it projects downwardly beyond the eyelet when the eyelet is supported on a hinge rod. In the extended position, the second part of the prop engages the rear wall of the bin while the first part forms a support for the lid of a trash bin in a partially open position. In the retracted position, the lid is free to swing fully open.

The rod supports of this invention provide reinforcement to a hinge rod of a trash bin lid to resist bending of the rod, and can also be used to retain a lid prop in an optimum position for supporting the lid in a partially open position. The lid prop of this invention is more compact, easier and less expensive to manufacture than prior art lid props, and is also very easy to use.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which.

DESCRIPTION OF THE PREFERRED EMBODIMENTS

Figure 1:
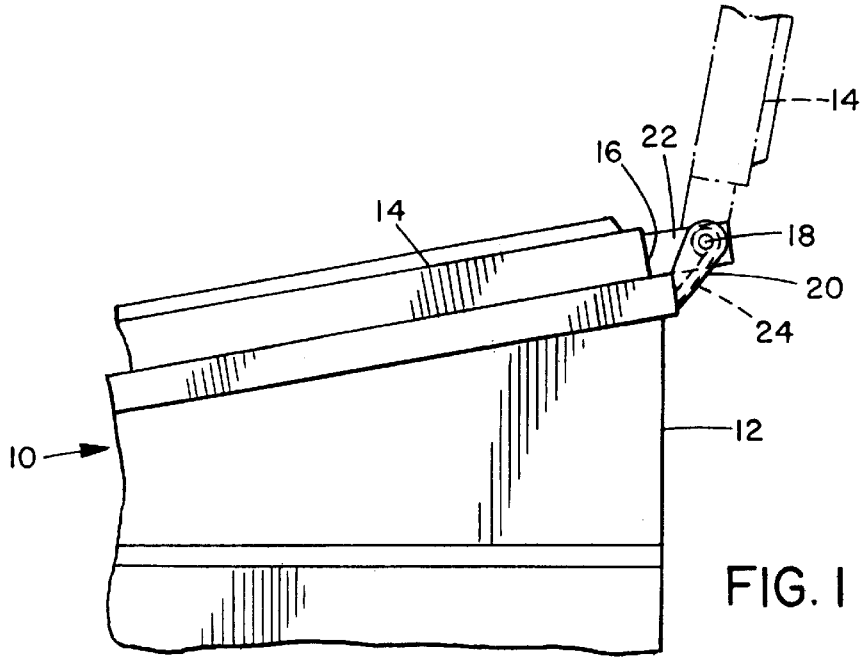
FIG. 1 is a side view of the upper rear portion of a typical trash bin, showing a rod support according to one embodiment of the invention.
Figure 2:
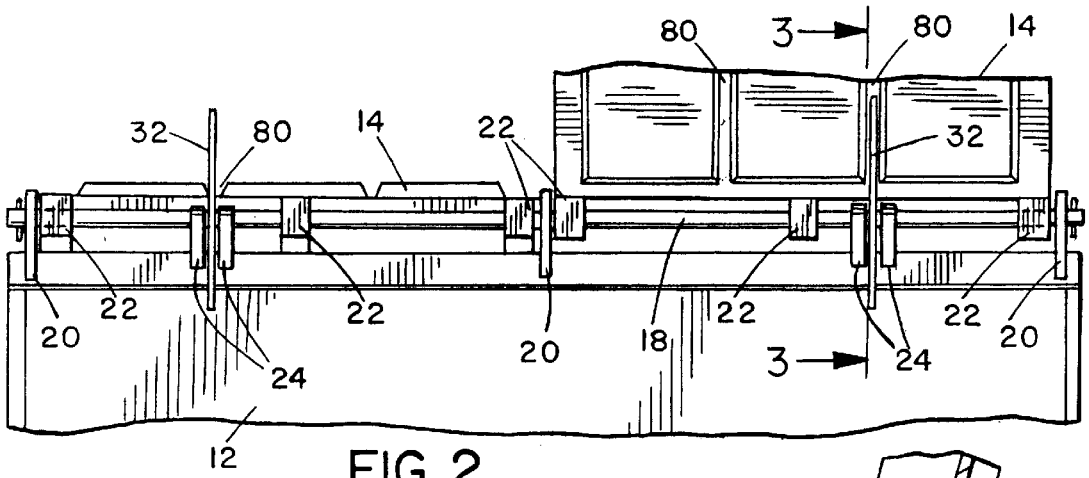
FIG. 2 is a rear view of the structure of FIG. 1, showing rod supports and a lid prop assembly according to another embodiment of the invention.
Figure 9:
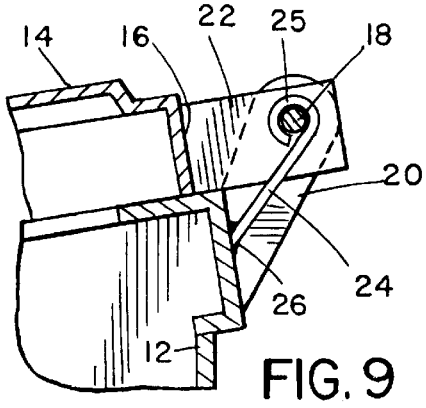
FIG. 9 is a sectional view taken on line 9—9 of FIG. 8.
Figure 3:
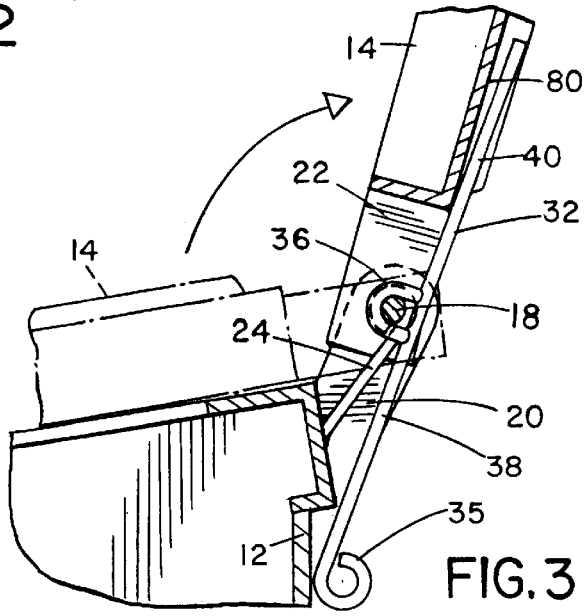
FIG. 3 is an enlarged sectional view taken on line 3—3 of FIG. 2, showing one configuration of a lid prop.
Figure 8:
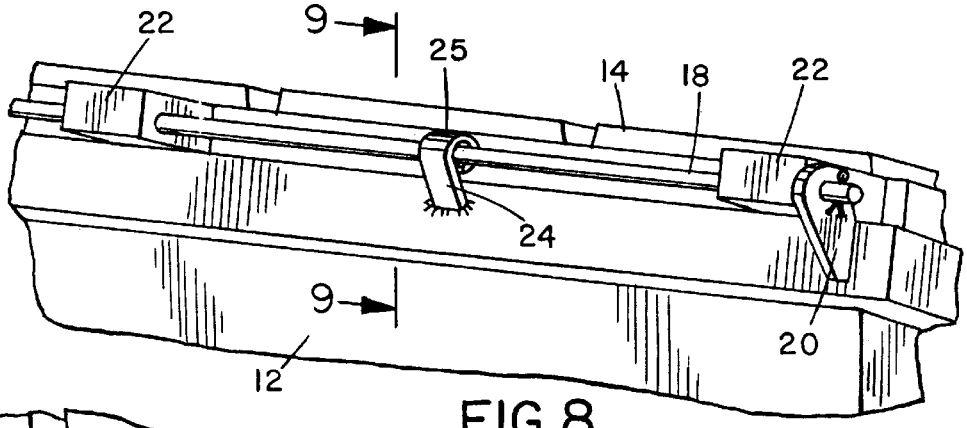
FIG. 8 is a perspective view showing the rod support of FIG. 1.

FIGS. 1, 8 and 9 of the drawings illustrate a lid rod support assembly for a trash bin according to a first embodiment of the present invention, while FIGS. 2 and 3 illustrate use of rod supports with a lid prop according to another embodiment of the invention. It will be understood that the hinge supports may be used alone or in conjunction with a lid prop, as described in more detail below. The lid prop and rod supports are particularly intended to be used for propping a trash bin lid in a partially open position, but may be used in other applications where it is desirable to prop a hinged container lid partially open.

FIGS. 1, 8 and 9 illustrate part of a commercial trash bin comprising a bin or container 10 having an open upper end and a rear wall 12, and a lid 14 having a rear edge 16 hinged to the upper end of rear wall 12. Typically, two lids 14 will be hinged side-by-side to the rear edge 16 of the bin, as described below in connection with FIG. 2. The hinge assembly comprises a hinge rod 18 secured between hinges 20 on rear wall 12, and a plurality of lugs 22 extending from the rear edge of the lid 14 and having openings rotatably engaged over the hinge rod. Clearly, the arrangement could be reversed with the hinge rod secured to the lid and the lugs secured to the rear wall of the bin. With this standard arrangement, the lid 14 can be rotated between a closed position covering the open top of the bin, as illustrated in solid outline in FIG. 1, and an open position. A partially open position is illustrated in dotted outline in FIG. 1. However, the lid may be rotated through around 270° into a fully open position lying along the rear wall of the container, unless any supports are provided for limiting this motion.

A rod support assembly according to a first embodiment of the present invention comprises at least two spaced rod supports 24. Preferably, at least one rod support 24 is placed between each adjacent pair of pivot lugs 22, as illustrated in FIG. 8. Each rod support comprises a flat, plate-like bracket which is bent over at one end to form an eyelet 25 for engagement over the hinge rod 18. Alternatively, the rod support may comprise a flat plate with a tube welded at one end to form the eyelet. Each rod support 24 is welded to the upper end of the rear wall of the bin at its end 26 remote from eyelet 25 so as to extend at an angle of approximately 45° to the rear wall of the bin. The configuration and orientation of the rod supports is such that contact with the lid is minimized.

The rod supports 24 together provide added strength and reinforcement to the lid rod 18, resisting bending of the rod between the lugs and reducing the risk of the lid becoming stuck in one position as a result of such bending. Unlike conventional hinges 20, which must be placed outside the outer side edges of each trash bin lid to avoid interference with proper lid opening, rod supports 24 are designed to be placed at locations directly behind the lid while still allowing the lid to open completely. Thus, rod supports 24 provide additional support to the lid rod.

The rod supports may be used alone on a commercial trash bin, or may be used in conjunction with a lid prop. FIGS. 2 and 3 illustrate a combination rod support and lid prop assembly 30 according to one embodiment of the invention. The trash bin in FIG. 2 has a pair of identical lids 14 pivoted side by side to lid rod 18. Each lid is associated with a lid prop assembly 30. Assembly 30 comprises a lid prop 32 and a pair of rod supports 24 positioned one on each side of the lid prop 32 on hinge rod 18, to prevent the prop 32 from sliding along the rod. The lid prop 32 of this embodiment comprises a single, elongate rod bent at one end to form an eyelet 35 and having a second eyelet 36 formed at an intermediate point in its length by means of a short, U-shaped bar or wire welded at both ends to the rod 34. As best illustrated in FIG. 3, eyelet 36 is slidably engaged over the lid rod 18 such that a first end portion or arm 38 of the rod projects generally downwardly and engages the rear wall 12 of the bin at eyelet 35, and the second end portion or arm 40 of the rod projects generally upwardly to form a prop or support for lid 14 when in the partially open position illustrated in solid outline in FIG. 3.

As illustrated in FIG. 2, a rod support 24 is mounted on the hinge rod 18 on each side of lid prop 32 so as to retain the prop in a desired central location on the hinge rod. Where the trash bin lid is of the type having grooves or channels 80 running from front to rear, as indicated in FIG. 2, the lid prop is preferably positioned in alignment with one of the grooves 80, so that it will engage in the groove when the lid is moved to the partially open position, as indicated on the right hand side in FIG. 2 and in FIG. 3. The assembly may be readily mounted on the hinge rod by first welding the end supports 24 at a central location on the rear wall with a small gap between them for receiving the lid prop, positioning the eyelet 36 between the eyelets 25 of the end supports, and sliding the hinge rod through the aligned eyelets 25 and 36. The lid prop is thus prevented from sliding along the hinge rod and is kept in the optimum position for supporting the lid 14.

Figure 4:
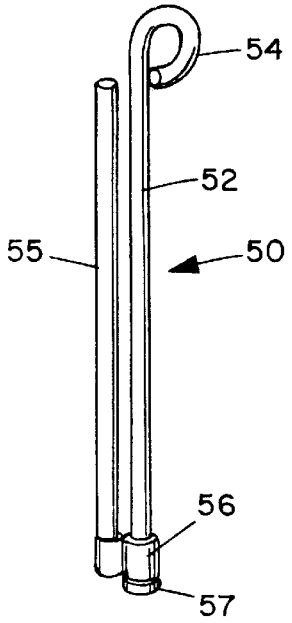
FIG. 4 is a perspective view of an alternative sliding lid prop.

In use, the lid may be rotated in the direction of the arrow in FIG. 4 between the closed position showed in dotted outline and the partially open position illustrated in solid lines. In the partially open position, the lid rests against the second end portion or arm 40 of the lid prop and is prevented from rotating any further. The lid prop therefore prevents the lid from flipping over backwards to lie against the rear wall of the bin. Users can therefore easily prop the lid partially open, deposit trash in the bin, and then reach the lid to pull it closed, without having to walk around to the back of the bin. The eyelet 35 at the lower end of the lid prop is provided for added weight so as to automatically rotate the rod back down into the position illustrated in FIG. 4 engaging the rear wall of the bin after the bin has been inverted to deposit trash in a trash truck. The rod supports 24 on each side of prop 32 prevent movement of prop 32 and resist bending of the lid rod 18.

Figure 5:
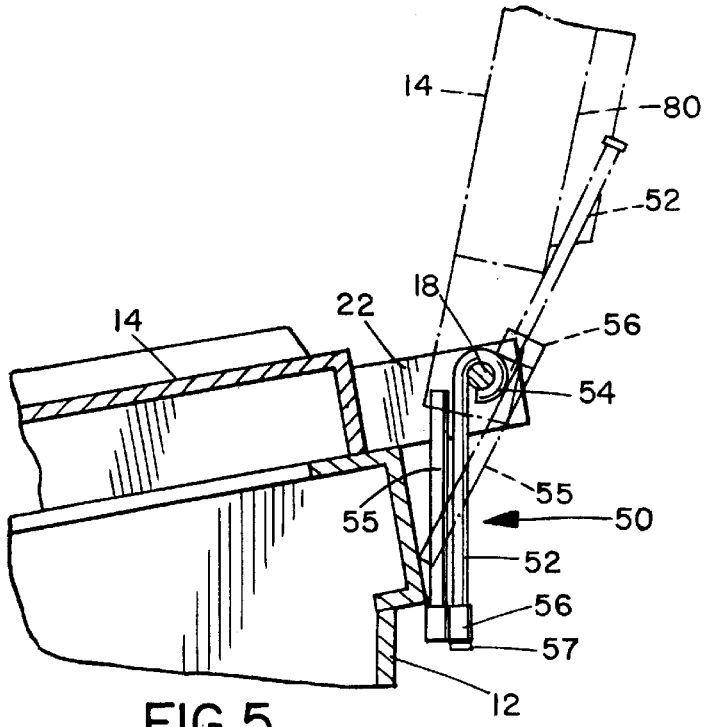
FIG. 5 is a view similar to FIG. 3, showing the prop of FIG. 4.
Figure 10:
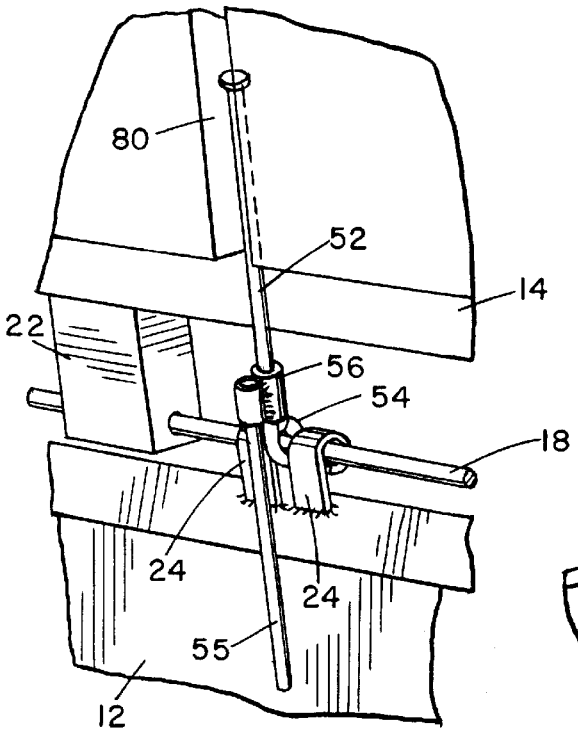
FIG. 10 is a perspective view showing the prop of FIGS. 4 and 5 between two rod supports.

FIG. 4 illustrates a lid prop 50 according to another embodiment of the invention, while FIGS. 5 and 10 illustrate the lid prop mounted on the hinge rod 18 of a trash bin in a similar manner to the lid prop 32 of FIGS. 2 and 3. The lid prop 50 is also used in conjunction with a pair of rod supports 24, one on each side of the prop 50, in order to resist sliding of the prop along a hinge rod 18, as illustrated in FIG. 10. The rod supports also provide reinforcement to resist bending of rod 18.

The lid prop 50 comprises a first rod 52 having an eyelet 54 at one end for rotatable engagement over a hinge rod 18, and a second rod 55 slidably connected to the first rod by means of sliding connector 56 projecting to one side of rod 55 and slidably engaged over rod 52. In this way, the second rod extends parallel to and alongside the first rod 52. The sliding connector 56 comprises a sleeve slidably mounted on rod 52 and welded tangentially to rod 55. Rod 52 has a stop 57 at one end which, together with eyelet 54 at the opposite end, prevents connector 56 from sliding off the rod. Rod 55 can therefore slide along the rod 52 from the fully retracted position illustrated in FIG. 4, in which connector 56 engages end stop 57, to the fully extended position illustrated in FIG. 10 and in dotted outline in FIG. 5, in which connector 56 engages the eyelet 54.

Eyelet 54 engages over the hinge rod 18 as illustrated in FIGS. 5 and 10, between two adjacent rod supports 24 to hold it in the optimum position. In the solid line position of FIG. 5, the lid 14 is free to rotate through 270° to lie against the rear wall 12 of the bin. If the lid is to be supported in a partially open position, as illustrated in FIG. 10 and in dotted outline in FIG. 5, the prop is simply rotated anti-clockwise about hinge pin 18, until the first rod 52 is inclined upwardly, while the second rod is extended downwardly via sliding connector 56 to engage the rear wall 12 at its lower end and hold the upper rod in the lid supporting position.

The lid prop 50 of this embodiment is also relatively inexpensive and simple to manufacture, and is readily movable between a first position allowing the trash bin lid to be rotated rearwardly and downwardly against the rear wall of the bin, and a second position for supporting the lid in a partially open position. Also, when used in combination with two rod supports positioned one on each side of prop 50, as illustrated for the prop 32 of FIG. 2, it is held in an optimum position for supporting the lid 14, and prevented from sliding laterally away from this position.

Figure 11:
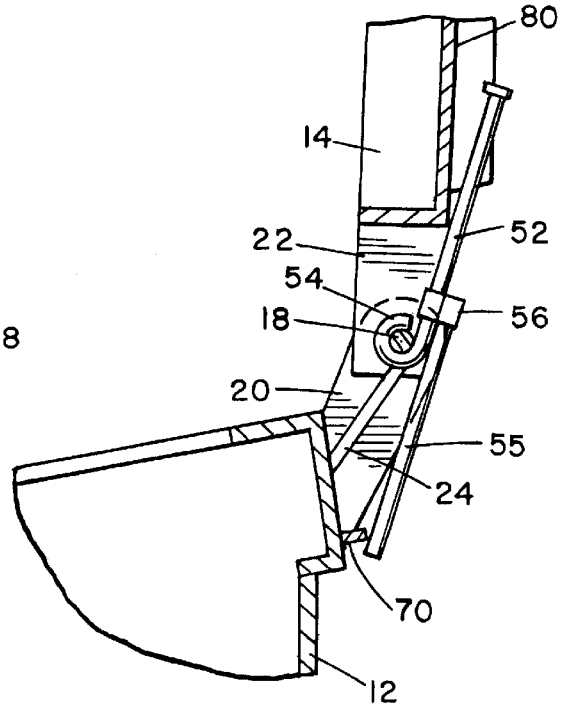
FIG. 11 is a view similar to the dotted line view of FIG. 5, with a spacer added to limit the angle of the prop and the lid.

FIG. 11 illustrates a modification in which a spacer 70 is added to limit the angle of the prop 50 and supported lid 14. This may be used where the design of the rear wall of the trash bin is such that the prop will be inclined at too great an angle to the rear wall if it is permitted to simply bear against the rear wall, as in FIGS. 5 and 10. As illustrated in FIG. 11, a plate 70 of suitable width is welded to the rear wall so as to project outwardly and form a stop for the prop, limiting the angle of the prop and lid relative to the rear wall.

Figure 6:
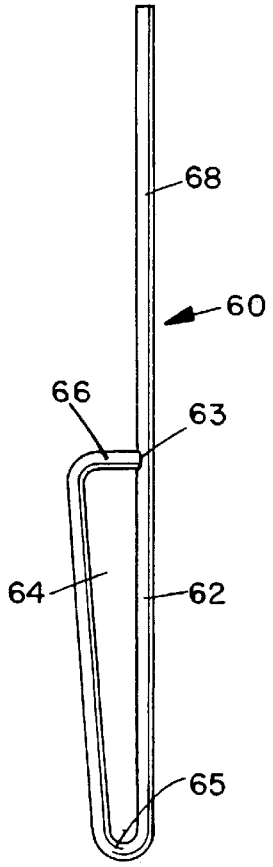
FIG. 6 is a side view of a further type of lid prop.
Figure 7:
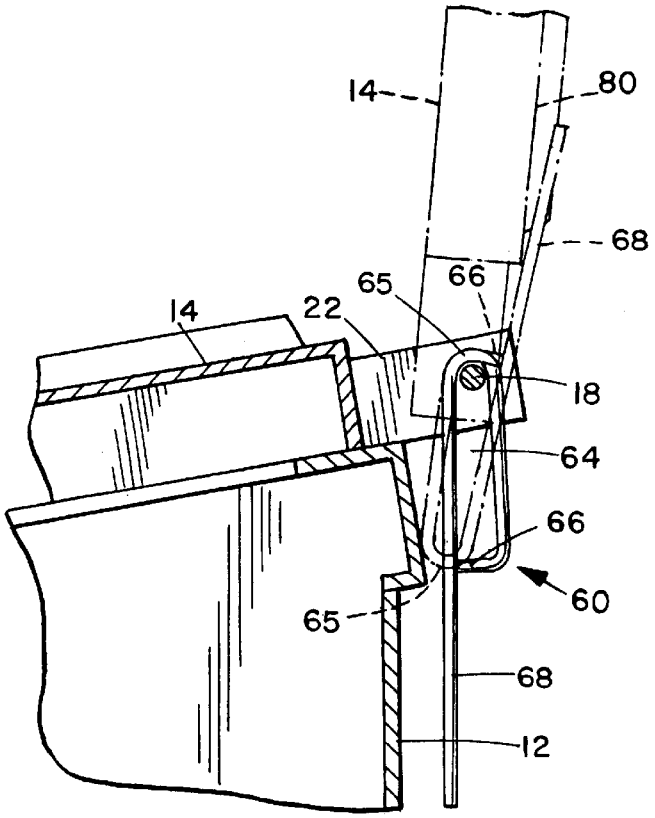
FIG. 7 is a view similar to FIG. 3, showing the prop of FIG. 6.

FIGS. 6 and 7 illustrate a lid prop 60 according to another embodiment of the invention, which is also intended to be used in combination of two of the rod supports 24 of FIG. 2, although the rod supports are omitted for clarity in FIG. 7. FIG. 6 is a side view of the prop 60, while FIG. 7 illustrates the lid prop mounted on the hinge rod 18 of a trash bin in a similar manner to the lid prop 32 of FIGS. 2 and 3. As noted above, the lid prop 60 is also intended to be used in conjunction with a pair of rod supports 24, one on each side of the prop 60, as in FIG. 2, in order to resist sliding of the prop along a hinge rod 18.

Lid prop 60 comprises a single elongate rod 62 which is bent over at one end and welded at an intermediate point 63 in its length to form an elongate loop or slot 64 which is designed to engage over hinge rod 18 as illustrated in FIG. 8. Slot 64 has a first end 65 and a second end 66, and a straight leg 68 of rod 62 extends from the second end 66 of the slot.

In the first position illustrated in solid outline in FIG. 7, the hinge rod 18 is located at the upper end 65 of slot 64, and the prop hangs vertically downwardly from rod 18. In this position, the lid 14 is free to flip completely over and rest against the rear wall 12 of the bin. If the lid is to be propped partially open, as illustrated in dotted outline in FIG. 7, the prop 60 is flipped over or rotated in an anti-clockwise direction between the solid line position of FIG. 7 and the dotted line position, and the slot 64 slides down until rod 18 engages the opposite end 66 of the slot. In this position, the lowermost end of the slotted portion of the rod engages the rear wall 12 of the bin, and the leg 68 extends upwardly at an angle to engage the lid 14 and hold it in a partially open position. The lid 14 bears against the prop, which in turn bears against the rear wall 12 of the bin. The prop therefore supports the lid securely in its partially open position. If the lid is to be swung fully open, the prop 60 is simply raised upwardly from the dotted line position of FIG. 7 to disengage from the rear wall, at which point it can be rotated in a clockwise direction back down to the solid line position.

In each of the embodiments of FIGS. 2 to 7, 10 and 11, an elongate lid prop is combined with a lid rod and a pair of rod supports to provide a lid prop assembly in which the prop cannot move laterally and the lid rod has additional support to resist bending.

Although some preferred embodiments of the invention have been described above by way of example only, it will be understood by those skilled in the field that modifications may be made to the disclosed embodiments without departing from the scope of the invention, which is defined by the appended claims.

We claim:

1. A trash bin apparatus, comprising:

a bin having an open top;

at least one lid for closing the open top of the bin, the lid having a front edge, opposite side edges, and a rear edge;

the bin having a rear wall with an upper rear edge;

a hinge assembly pivotally connecting the rear edge of the lid to the rear edge of the bin for allowing the lid to pivot between a closed position covering the open top of the bin and an open position spaced from the open top of the bin;

the hinge assembly comprising spaced hinges secured to the rear wall of the bin adjacent and spaced outwardly from the respective opposite side edges of the lid, and a hinge rod extending between the hinges and pivotally connected to the rear edge of the bin; and at least two rod supports secured at spaced intervals to the rear wall of the bin between the hinges and behind the lid, each rod support comprising a rigid member secured to the rear wall at a predetermined angle and having an opening engaging over the hinge rod for supporting the hinge rod and resisting bending of the rod, whereby the rod supports do not restrict movement of the lid between the closed and open position.

2. The apparatus as claimed in claim 1, wherein two lids are provided for closing the open top of the bin, a single hinge rod is pivotally connected to the rear edges of both lids, each lid rear edge having a plurality of spaced projections rotatably engaging over said rod, and at least one rod support is mounted between each adjacent pair of projections.

3. The apparatus as claimed in claim 1, wherein each rod support comprises a flat strip of metal having opposite ends, one end of the strip being welded to the rear wall of the bin so that said strip projects at said predetermined angle, and the opposite end of the rod having an eyelet engaging over said rod.

4. The apparatus as claimed in claim 3, wherein the opposite end of the strip is bent over to form said eyelet engaging over the hinge rod.

5. A combined lid prop and rod support apparatus for a trash bin lid, comprising:

a lid rod for pivotal connection to a rear edge of the trash bin lid;

an elongate lid prop having an opening engaging over the lid rod, a first portion of the lid prop extending away from the opening in a first direction to provide a support for the trash bin lid in a partially open position, and a second portion of the lid prop extending in a second direction away from the first direction to engage a rear wall of a trash bin;

a pair of rod supports engaging over the lid rod on opposite sides of the lid prop to prevent sliding of the lid prop along the lid rod, each rod support having a first end with an eyelet engaged over the lid rod, and a second end for securing to the rear wall of the trash bin; and the lid prop comprising an elongate rod having a first eyelet secured at an intermediate position in its length to form said opening; and a second eyelet formed at one end for resting against the rear wall of the trash bin.

6. A combined lid prop and rod support apparatus for a trash bin lid, comprising:

a lid rod for pivotal connection to a rear edge of the trash bin lid;

an elongate lid prop having an opening engaging over the lid rod, a first portion of the lid prop extending away from the opening in a first direction to provide a support for the trash bin lid in a partially open position, and a second portion of the lid prop extending in a second direction away from the first direction to engage a rear wall of a trash bin;

a pair of rod supports engaging over the lid rod on opposite sides of the lid prop to prevent sliding of the lid prop along the lid rod, each rod support having a first end with an eyelet engaged over the lid rod, and a second end for securing to the rear wall of the trash bin; and the lid prop comprising a first part having said opening and a second part slidably mounted on the first part, the first part comprising said first portion of said lid prop and the second part comprising said second portion.

7. The apparatus as claimed in claim 6, wherein the first and second parts comprise first and second elongate rods, respectively, the first rod having an eyelet at one end comprising said opening, and a slidable connector slidably connecting the second rod to the first rod for movement between a first, retracted position extending alongside and parallel to the first rod, and a second, extended position extending away from said first rod eyelet to engage the rear wall of a trash bin to support a trash bin lid in a partially open position.

8. The apparatus as claimed in claim 7, wherein the slidable connector comprises a sleeve slidably mounted on the first rod and tangentially welded to the second rod.

9. A trash bin apparatus, comprising:

a bin having an open top;

at least one lid for closing the open top of the bin, the lid having a front edge, opposite side edges, and a rear edge;

the bin having a rear wall with an upper rear edge;

a hinge assembly pivotally connecting the rear edge of the lid to the rear edge of the bin for allowing the lid to pivot between a closed position covering the open top of the bin and an open position s paced from the open top of the bin;

the hinge assembly comprising spaced hinges secured to the rear wall of the bin adjacent and spaced outwardly from the respective opposite side edges of the lid, and a hinge rod extending between the hinges and pivotally connected to the rear edge of the bin;

an elongated lid prop having an opening engaged over the hinge rod, a first portion of the lid prop extending away from the opening in a first direction to provide a support for the trash bin lid in a partially open position and a second portion of the lid prop extending away from the opening in a second direction for engaging the rear wall of the trash bin; and at least two rod supports engaging over the hinge rod on opposite sides of the lid prop to prevent lateral movement of the lid prop along the hinge rod, each rod support comprising a rigid member secured to the rear wall at a predetermined angle and having an eyelet engaging over the hinge rod for supporting the hinge rod and resisting bending of the rod.

10. The apparatus as claimed in claim 9, wherein said lid has an upper surface, a series of spaced grooves in said upper surface between said front and rear edges, said lid prop being aligned with a respective one of said grooves for engagement in said groove in said partially open position of said lid.

11. The apparatus as claimed in claim 9, including a stop member projecting outwardly from said rear wall at a location spaced below said lid prop opening, said stop member being positioned for engagement with said second portion of said lid prop to control the orientation of said lid prop and said lid in the partially open position of said lid.

12. The apparatus as claimed in claim 9, wherein the lid prop is mounted in a stationary and non-movable position on the hinge rod, the stationary lid prop comprising a single elongate rod with said opening at an intermediate position in its length engaged over the hinge rod, a first end portion of the rod on one side of the opening engaging and supporting the lid when it is opened and an opposite second end of the rod on the opposite side of the opening engaging the rear wall of the bin.

13. The apparatus as claimed in claim 12, wherein the second end of the elongate rod is bent to form a second opening.

14. The apparatus as claimed in claim 9, wherein the lid prop is movable between a first position in which it props the lid in the partially open position and a second position in which it allows the lid to swing fully open and lie against the rear wall of the bin.

15. The apparatus as claimed in claim 14, wherein the lid prop comprises a single elongate rod bent back at one end and re-attached at an intermediate point in its length to form an elongate slot comprising the opening engaging over the hinge rod, the slot having a first end at said intermediate point and a second end, and the rod having a straight end portion projecting from said intermediate point and away from said slot, the lid prop being movable between said first position in which the first end of the slot engages over the hinge rod at the intermediate point of the length of the rod, the straight end portion of the rod projects generally upwardly to form the prop for the lid in the partially open position, and the bent end of the rod engages the rear wall of the bin, and said second position in which the second end of the slot engages the hinge rod and the prop is rotated downwardly so that said slot and straight end portion hang substantially vertically downwardly and the lid can be swung fully open to lie alongside the bin rear wall.

16. The apparatus as claimed in claim 9, herein the lid prop is formed in separate first and second parts, the first part having an opening at one end engaging over the hinge rod, the second part being slidably connected to the first part for movement between a first position in which it projects downwardly from the first part to engage the rear wall of the bin with the first part projecting upwardly to support the lid in the partially open position, and a second position in which it extends alongside the first part and both parts extend downwardly from the hinge rod to allow the lid to be swung fully open to lie alongside the bin rear wall.

17. The apparatus as claimed in claim 16, wherein the first and second parts comprise first and second elongate rods, and a slidable connector slidably connects the second rod to the first rod to extend parallel to the first rod for movement between a retracted position extending alongside the first rod and an extended position extending away from said opening, the second rod in the extended position engaging the rear wall of the bin while the first rod forms a support for the lid of the trash bin in the partially open position.

18. A method for propping a trash bin lid in a partially open position over the open top of a trash bin, comprising the steps of:

disposing an elongate lid prop on said trash bin, the prop having an opening engaging over a hinge rod of said trash bin extending between hinges of the lid, the lid prop having elongate first and second end portions extending in opposite directions from said hinge rod at least in a first position of said prop;

engaging an eyelet on each one of first and second rod supports over the hinge rod on opposite sides of said lid prop, and securing said rod supports to a rear wall of said trash bin to retain said lid prop in a predetermined axial position on said hinge rod and prevent sliding movement of said lid prop lengthwise along said hinge rod, each rod support comprising a rigid member secured to the rear wall of the trash bin at a predetermined angle, the eyelet supporting the hinge rod and resisting bending of the rod; and opening said lid until said lid is in contact with one of said end portions and the other of said end portions is in contact with the rear wall of said container in order to hold the lid in a partially open position.

19. A trash bin apparatus, comprising:

a bin having an open top;

a pair of lids for closing the open top of the bin, each lid having a front edge, an outer side edge adjacent an outer side edge of the bin, an inner side edge adjacent the other lid, and a rear edge;

the bin having a rear wall with an upper rear edge;

a hinge assembly pivotally connecting the rear edge of each lid to the rear edge of the bin for allowing the lids to pivot between a closed position covering the open top of the bin and an open position spaced from the open top of the bin;

the hinge assembly comprising three spaced hinges secured to the rear wall of the bin, including first and second hinges adjacent and spaced outwardly from the respective outer side edges of the two lids, and a third hinge located between the lids, and a hinge rod extending between the hinges and pivotally connected to the rear edge of the bin; and at least two rod supports secured at spaced intervals to the rear wall of the bin such that each rod support is positioned between an adjacent pair of hinges behind a respective lid, each rod support comprising a rigid member secured to the rear wall at a predetermined angle and having an opening engaging over the hinge rod for supporting the hinge rod and resisting bending of the rod, whereby the rod supports do not restrict movement of the lid between the closed and open position.

20. A trash bin apparatus, comprising:

a bin having an open top;

a pair of lids arranged side-by-side for closing the open top of the bin, each lid having a front edge, opposite side edges, and a rear edge;

the bin having a rear wall with an upper rear edge;

a hinge assembly pivotally connecting the rear edges of the lids to the rear edge of the bin for allowing the lids to pivot between a closed position covering the open top of the bin and an open position spaced from the open top of the bin;

the hinge assembly comprising three spaced hinges secured to the rear wall of the bin adjacent, two of the hinges being located adjacent the outermost side edges of the respective lids and a third hinge being located between the lids, and a hinge rod extending between the hinges and pivotally connected to the rear edge of the bin;

a pair of elongated lid props each having an opening engaged over the hinge rod, each lid prop being located behind a respective lid, a first portion of the lid prop extending away from the opening in a first direction to provide a support for the respective trash bin lid in a partially open position and a second portion of the lid prop extending away from the opening in a second direction for engaging the rear wall of the trash bin; and at least two rod supports engaging over the hinge rod on opposite sides of each lid prop to prevent lateral movement of the lid prop along the hinge rod, each rod support comprising a rigid member secured to the rear wall at a predetermined angle and having an eyelet engaging over the hinge rod for supporting the hinge rod and resisting bending of the rod.

* * * * *

UNITED STATES PATENT AND TRADEMARK OFFICE

CERTIFICATE OF CORRECTION

PATENT NO. : 6,276,562 B1
DATED : August 21, 2001
INVENTOR(S) : Hodge, Allan M. et al.

It is certified that error appears in the above-identified patent and that said Letters Patent is hereby corrected as shown below:

Column 9,
Line 1, change “s paced” to -- spaced --.

Column 10,
Line 1, change “herein” to -- wherein --.

Signed and Sealed this

Eighteenth Day of June, 2002

*Attest:*

*Attesting Officer*

JAMES E. ROGAN
*Director of the United States Patent and Trademark Office*